US011186002B2

(12) United States Patent
Starr et al.

(10) Patent No.: US 11,186,002 B2
(45) Date of Patent: Nov. 30, 2021

(54) DUETTE VERSATILE MULTI-HEADED SHAVER

(71) Applicant: Carol Starr, Wolverine Lake, MI (US)

(72) Inventors: Carol A. Starr, Wixom, MI (US); Kenan Wollborg, Inkster, MI (US)

( * ) Notice: Subject to any disclaimer, the term of this patent is extended or adjusted under 35 U.S.C. 154(b) by 0 days.

(21) Appl. No.: 16/042,967

(22) Filed: Jul. 23, 2018

(65) Prior Publication Data

US 2021/0053240 A1 Feb. 25, 2021

(51) Int. Cl.

*B26B 21/52* (2006.01)
*B26B 21/22* (2006.01)
*B26B 21/46* (2006.01)

(52) U.S. Cl.

CPC ..... *B26B 21/521* (2013.01); *B26B 21/222* (2013.01); *B26B 21/46* (2013.01); *B26B 21/526* (2013.01)

(58) Field of Classification Search

CPC ..... B26B 21/521; B26B 21/526; B26B 21/46; B26B 46/222

See application file for complete search history.

(56) References Cited

U.S. PATENT DOCUMENTS 2,748,470 A * 6/1956 Borden ..... B26B 21/52 30/531
4,094,062 A * 6/1978 Papanikolaou ..... B26B 21/46 30/34.05
4,501,066 A * 2/1985 Sceberras ..... B26B 21/52 30/47
4,720,917 A 1/1988 Solow
4,754,548 A * 7/1988 Solow ..... B26B 21/4006 30/32
4,791,724 A 12/1988 Dumas
5,426,853 A 6/1995 McNinch
5,865,189 A * 2/1999 Andrews ..... B26B 21/00 132/200
5,953,825 A * 9/1999 Christman ..... B26B 21/225 30/50
6,141,875 A 11/2000 Andrews
6,308,416 B1 10/2001 Bosy et al.
6,434,828 B1 * 8/2002 Andrews ..... B26B 21/00 30/50
8,205,343 B2 * 6/2012 Winter ..... B26B 21/40 30/527
8,387,259 B2 * 3/2013 Starr ..... B26B 21/52 30/50
8,474,144 B2 7/2013 Royle
9,289,908 B2 * 3/2016 Marder ..... B26B 21/52
9,701,033 B2 7/2017 Tracy
(Continued)

FOREIGN PATENT DOCUMENTS

FR 2935920 B1 3/2010
JP 5215761 B2 6/2013
WO 2007039737 A1 4/2007

*Primary Examiner* — Hwei-Siu C Payer
(74) *Attorney, Agent, or Firm* — Brooks Kushman P.C.

(57) ABSTRACT

A shaver is disclosed and includes a handle with a plurality of razor-heads attached to a plurality of arms. The razor-heads being adjustable to accommodate shaving areas of different shapes and sizes. The razor-heads provide versatile maneuverability by incorporating movement about at least two distinct axes for each razor-head. Each razor-heads' maneuverable range functions independent of any additional razor-heads.

20 Claims, 4 Drawing Sheets

(56) References Cited

U.S. PATENT DOCUMENTS

| | | | | |
|---|---|---|---|---|
| 2007/0107229 | A1* | 5/2007 | Ribal | B26B 19/46 30/34.05 |
| 2011/0138637 | A1* | 6/2011 | Bucco | B26B 21/521 30/527 |
| 2014/0259679 | A1* | 9/2014 | Tracy | B26B 21/521 30/50 |
| 2016/0263757 | A1* | 9/2016 | Vandervelde | B26B 21/4062 |
| 2017/0100272 | A1* | 4/2017 | Pathak | A61J 7/00 |
| 2019/0255721 | A1* | 8/2019 | Psimadas | B26B 21/523 |
| 2021/0053240 | A1* | 2/2021 | Starr | B26B 21/52 |

* cited by examiner

DUETTE VERSATILE MULTI-HEADED SHAVER

TECHNICAL FIELD

The present disclosure relates in general to hand-held shavers and safety-razors with multiple razor-heads.

BACKGROUND

Recently, shaving has been predominantly accomplished by individuals using a traditional T-bar shaped shaver. The T-bar shaver generally comprises a single razor-head in which one or more blades are oriented perpendicular to an elongated handle forming a T-like shape. These shavers may be disposable after limited use or may have interchangeable razor-head cartridges that can be removed, disposed, and replaced. An example of this type of shaver is disclosed in U.S. Pat. No. 8,474,508. A shaver with a single razor-head is generally used for all shaving tasks regardless of the area of the body to be shaved. Although individual razor-heads come in differing sizes and configurations they are generally standardized and are usually of minimal size to accommodate finer, more detailed work such as the contours of the face and mouth.

Shavers with multiple razor-heads for various purposes are also known. Some shavers with multiple razor-heads are utilized to provide the ability to shave in two different directions and are referred to as bi-directional shavers. An example of this bi-directional shaver is disclosed in U.S. Pat. No. 6,141,875. Multi-headed shavers that are not simultaneously operable are further disclosed. These shavers usually include razor-heads of differing sizes and orientations in which the razor-heads face in opposing directions. These shavers may include a larger razor-head to efficiently accommodate larger shaving tasks for larger areas of the body and a smaller razor-head for more detailed shaving tasks in smaller areas of the body. An example of this type of razor is disclosed in U.S. Pat. No. 6,052,905. Multi-headed shavers that operate simultaneously have also been disclosed and make shaving large body parts such as the head or chest more efficient. An example of this type of shaver is disclosed in U.S. Pat. No. 9,701,033.

Shavers may be employed to remove or shorten hair on small or large areas of the body. Additionally, shaving may occur on curved areas of the body. Accordingly, it would be desirable to provide a shaver that efficiently accommodates shaving all areas of the body. Further, a shaver that accommodates shaving all areas of the body without interchanging, removing, or adding parts would be desirable.

A versatile multi-headed shaver comprising a plurality of razor-heads with a wide range of maneuverability could accommodate shaving tasks of various shapes and sizes. Such a shaver may also be able to accommodate shaving tasks of various shapes and sizes with minimal assembly or disassembly. The disclosed invention may accommodate some or all desirable features.

SUMMARY

In at least one embodiment of this invention, there is a shaver comprising a handle, a plurality of arms, and a plurality of razor-heads. The handle having a proximal portion and a distal portion. Each arm having a proximal portion and a distal portion. The proximal portion of said arm connected to the distal portion of the handle. Each of the razor-heads is connected to the distal portion of an arm. The shaver also comprises at least a first plurality of pivotal joints. Each razor-head being connected to at least one pivotal joint. Wherein, each razor-head is configured to rotate around at least two distinct axes-of-rotation independent of the rotation of any other razor-head.

In some embodiments, each pivotal joint of the first plurality of pivotal joints is located at the connection between each arm and the handle. In some embodiments, each pivotal joint of the first plurality of pivotal joints is located at the connection between each arm and each razor-head. In some embodiments, each pivotal joint of the first plurality of pivotal joints may be located within each arm. In some embodiments, the shaver comprises a first and second plurality of pivotal joints that cooperate to allow each razor-head to rotate around two distinct axes-of-rotation independent of any other razor-head. In some embodiments, each razor-head may be configured to rotate around three or more axes-of-rotation independent of the rotation of any other razor-head. In some embodiments, each arm is rotatably connected to the distal portion of the handle forming the first plurality of pivotal joints. In some embodiments, there is a first and second plurality of pivotal joints wherein the first plurality of pivotal joints allows each razor-head to rotate around a first axis-of-rotation that is generally parallel to the connected arm and the second plurality of pivotal joints allows each razor-head to rotate around a second axis-of-rotation that is generally perpendicular to the first axis-of-rotation. In some embodiments, the razor-heads are removable cartridges. In some embodiments, the handle may further rotate around an axis-of-rotation. In some embodiments, the shaver may further comprise bi-directional razor blades. In some embodiments, the shaver may further comprise a razor-head a fixed orientation that does not rotate around an axes-of-rotation. In some embodiments, the shaver may comprise a locking mechanism at one or more pivotal joints to restrict the rotation around an axis-of-rotation. In some embodiments, the shaver may further comprise an light source, and power source wherein the power source is located within the handle and powers the light source.

The disclosure also includes a method of using one embodiment of the shaver comprising rotating each razor-head around a first axis-of-rotation to the desired position, rotating each razor-head around a second axis-of-rotation to a desired position and then moving the shaver so that the razor-heads move along a surface severing a protruding hair.

BRIEF DESCRIPTION OF THE DRAWING

Embodiments of the present disclosure are described herein with reference to the accompanying drawings wherein.

DETAILED DESCRIPTION

Figure 6:
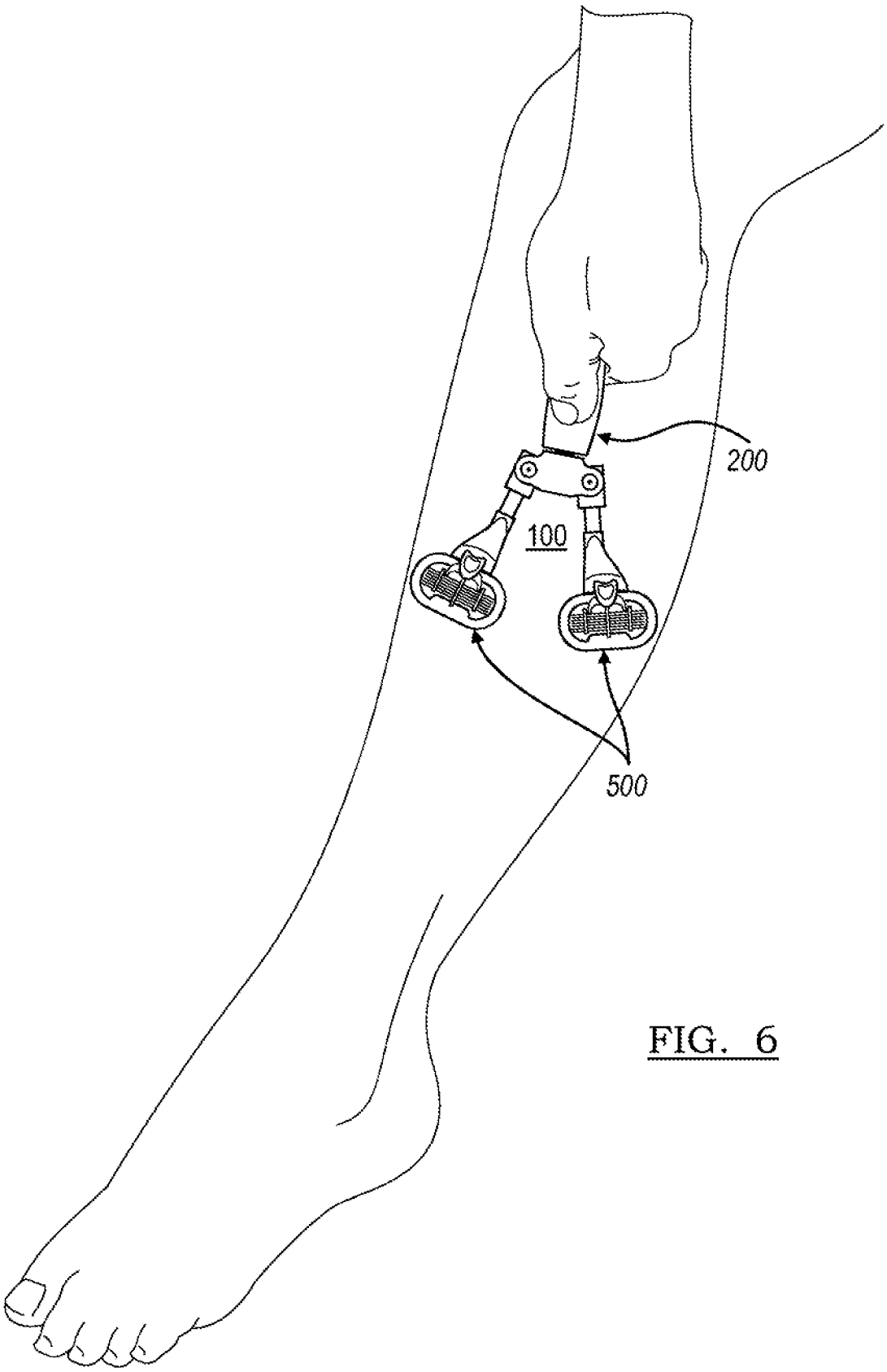
FIG. 6 is someone using the shaver in FIG. 1.

This disclosure incorporates U.S. Pat. No. 8,387,259 by reference in its entirety. Embodiments of the presently disclosed shavers are described in detail with reference to the drawings, in which the numerals designate corresponding elements in each of the several views. As in FIG. 6, the term proximal refers to the portion nearest the end where the user holds the shaver during use and distal refers to the portion furthest from the end where the user holds the shaver. The drawings illustrate one embodiment of the invention.

Figure 1:
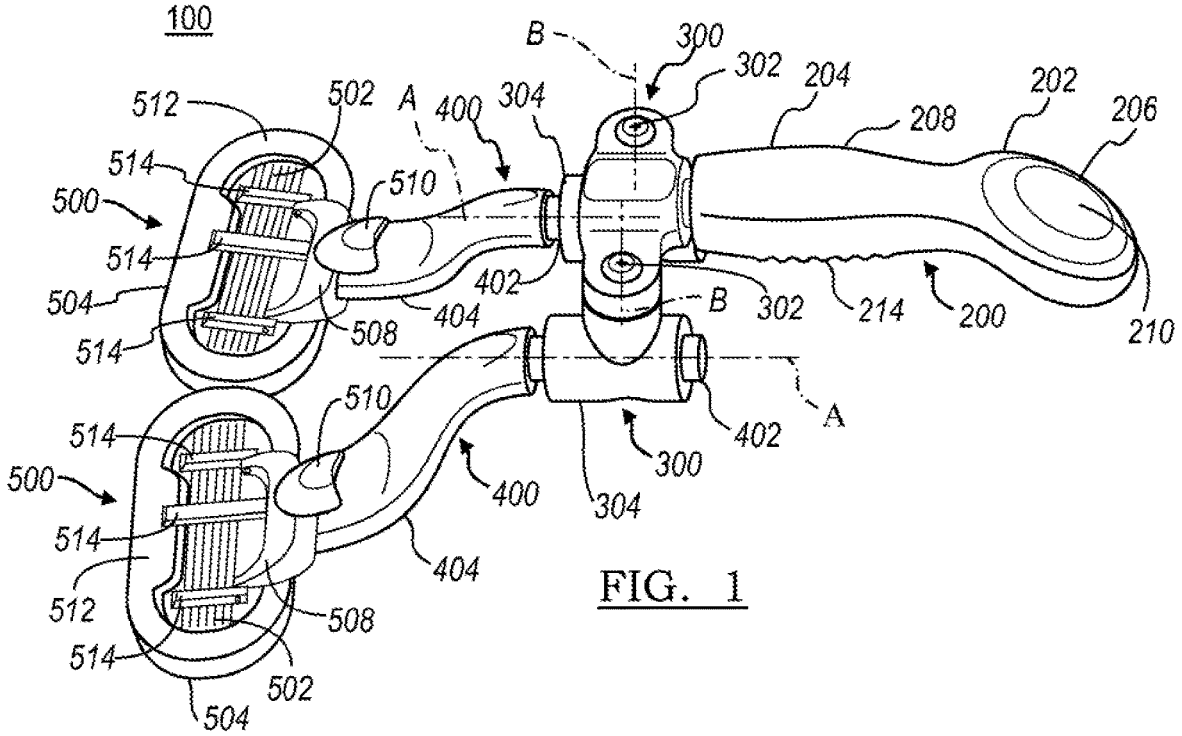
FIG. 1 is a perspective view of the top of the shaver according to the present disclosure.

FIG. 1 is a shaver 100 comprising a handle 200, a plurality of arms 400, a plurality of razor-heads 500 and a plurality of pivotal joints 300. The handle 200 being connected to the plurality of arms 400, and each of the of arms being connected to one of the razor-heads 500. In some embodiments the pivotal joints 300 are located at the connection between the handle 200 and each of the of the arms 400, or the connection between each of the arms 400 and one of the plurality of razor-heads 500.

Figure 3:
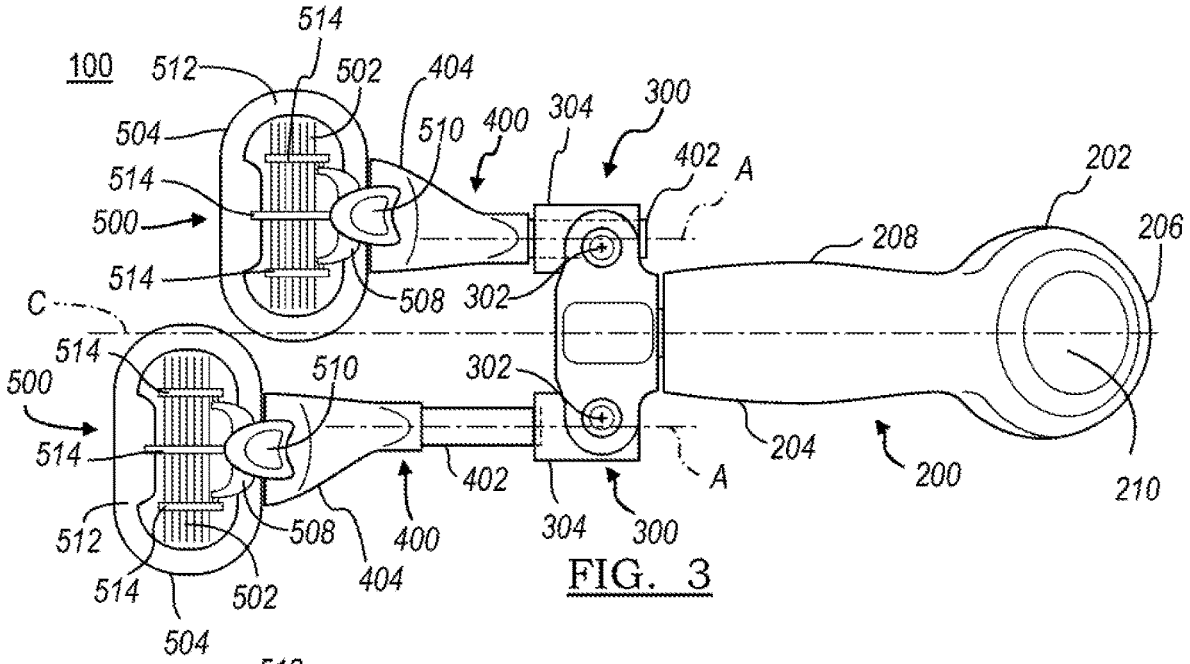
FIG. 3 is top view of the shaver in FIG. 1.
Figure 4:
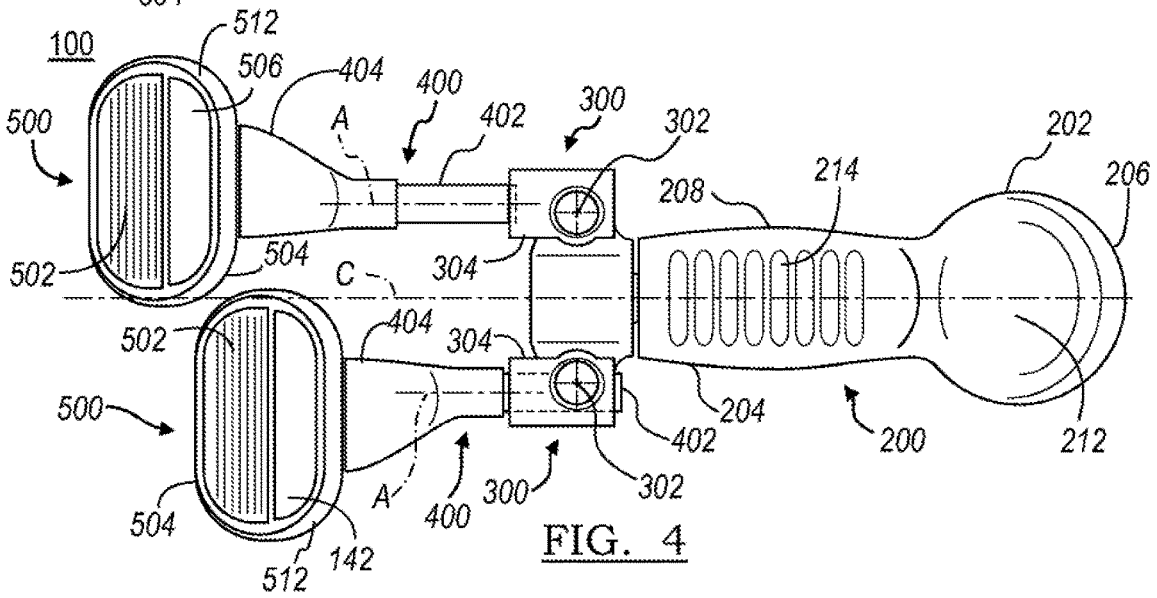
FIG. 4 is a bottom view of the shaver in FIG. 1.

The handle 200 may be elongated as in FIG. 1 and include a proximal portion 202 and distal portion 204. The handle 200, may comprise a disc shaped portion 206 at the proximal end as best shown in FIG. 3. Referring again to FIG. 1, the disc shaped portion 206 may be connected to a convex pillar shaped portion 208. The pillar shaped portion may extend from the disc shaped portion 206 to the distal end. In some embodiments, the disc shaped portion 206 may have a diameter of about 20 to 30 millimeters and a height of about 1 to 5 millimeters. In some embodiments, as in FIG. 1, the disc shaped portion 206 may include a convex surface 210 on top and a concave surface 212 on bottom 212. The pillar shaped portion 208 may have a diameter of about 5 to 20 millimeters, and a length of about 45 to 130 millimeters. Referring to FIG. 4, the handle 200 may include ribs 214 on the bottom of the handle 200 to improve grip. The ribs may have a depth of about 0.25 to 3 millimeters. As in FIG. 6, the handle 200 may be formed from any suitable material sufficiently rigid to hold the desired shape and durable enough to prevent breaking, cracking, or unrecoverable deformation under the pressure necessary for the razor-heads 500 to sever a hair. The handle 200 may be composed of non-corrosive material that does not deform or degrade when exposed to water such as polypropylene.

Figure 5:
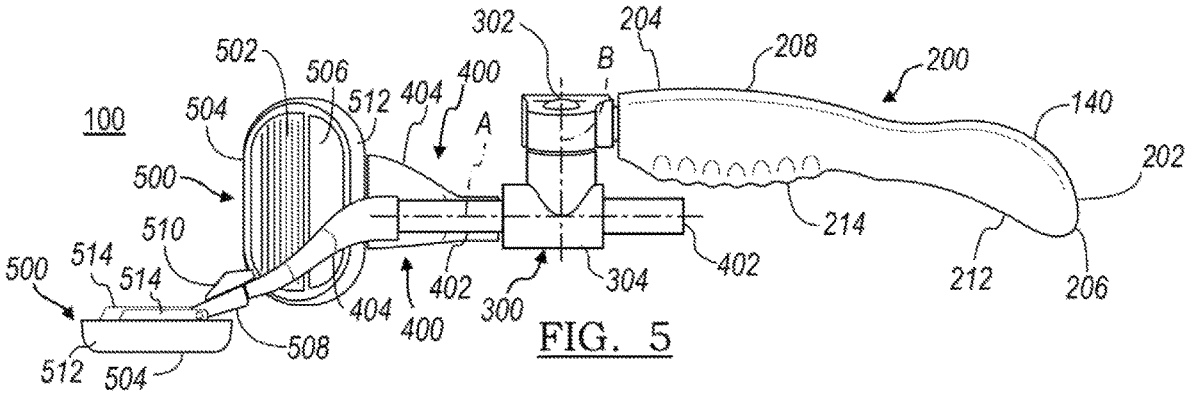
FIG. 5 is a side view of the shaver in FIG. 1.

As in FIG. 1, the plurality of arms 400 each have a proximal portion and a distal portion. In some embodiments, the proximal portion of each arm 400 may connect to the handle 200 and the distal portion of each arm 400 may connect to one of the plurality of razor-heads 500. In some embodiments, as in FIG. 5, each arm 400 may include a round shaft portion 402 connected to a downward sloping portion 404. In some embodiments, each shaft portion 402 may connect to the distal portion of the handle 204 by being disposed in a hollow cylindrical receptacle 304. In some embodiments, each downward sloping portion 404 may connect to a razor-head 500.

In some embodiments, the shaft portion 402 of each arm 400 may have a diameter of about 2 to 12 millimeters and a length of about 15 to 30 millimeters. In some embodiments the downward sloping portion 404 nearest the round shaft portion 402 may be round and may have a diameter of about 5 to 15 millimeters. In some embodiments, as in FIG. 5, the downward sloping portion 404 may flatten as it digresses from the shaft portion 402. In some embodiments, the initial height of the flattened portion may be about 3 to 10 millimeters with a width of about 5 to 15 millimeters. In some embodiments, the height at the most distal portion of the arm may remain approximately the same. In some embodiments, as in FIG. 3, the width at the most distal end of the arm may increase to about 15 to 25 millimeters. In some embodiments, as in FIG. 5, the most distal portion of the downward sloping portion 404 may be about 10 to 30 millimeters lower than the most proximal portion of the downward sloping portion 404 and may have a slope of about 10 to 75 degrees. The distance from the most proximal portion of the downward sloping portion 404 to the most distal portion of the downward sloping portion 404 may be about 20 to 40 millimeters.

The arms 400 may be formed from any suitable material sufficiently rigid to hold the desired shape and durable enough to prevent breaking, cracking, or unrecoverable deformation under the pressure necessary for the razor-heads 500 to operate. The arms 400 may be composed of non-corrosive material that does not deform or degrade when exposed to water such as polypropylene.

Figure 2:
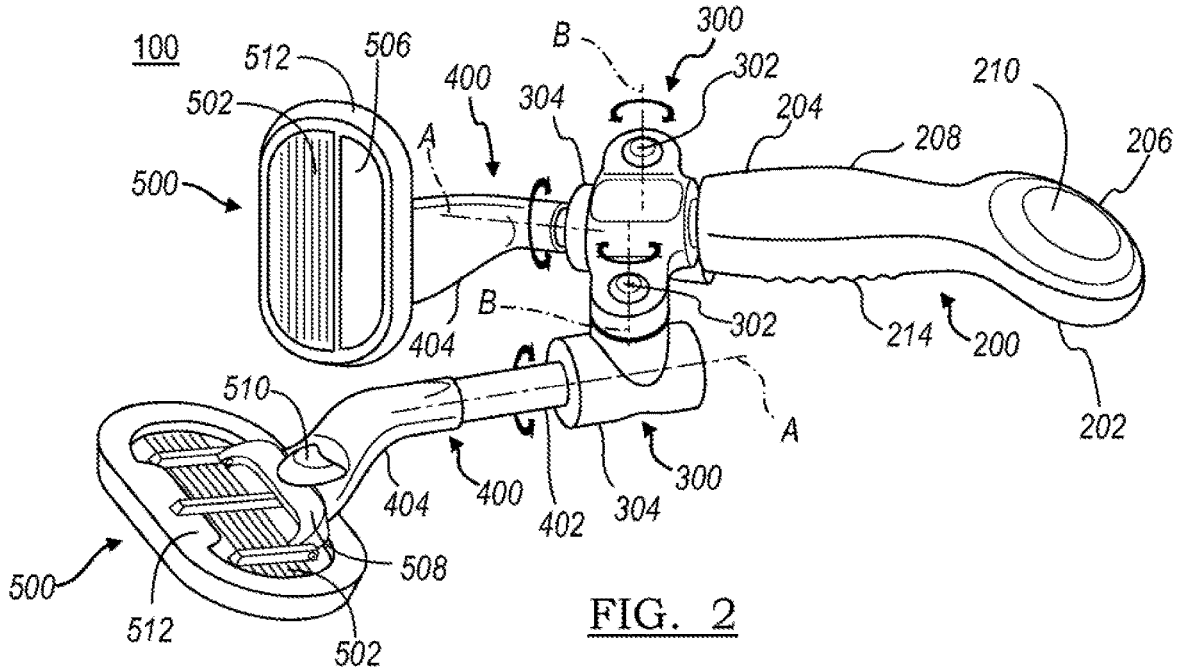
FIG. 2 is another side perspective view of the top of the shaver in FIG. 1.

In some embodiments, as in FIG. 2, each razor-head 500 may include multiple razor blades 502, a razor blade seat 504, and a guard 506. Referring to the embodiment of FIG. 3, the razor-heads 500 may comprise a stadium shaped frame 512. In some embodiments, the round portions of the stadium shaped frame 512 may have a diameter of about 10 to 35 millimeters and the distance between the center of each round portion may be about 10 to 75 millimeters. In some embodiments, the razor-heads 500 may have a thickness of about 0.25 to 10 millimeters. In some embodiments, as in FIG. 3, each stadium shaped frame 512 is connected to three columns 514 extending from the proximal portion of the razor-head 500 to the distal portion. The frame 512 and columns 514 may cooperate to form a razor blade seat 504 as in FIG. 3. In some embodiments, the columns 514 may have a length of about 10 to 35 millimeters, a width of about 1 to 5 millimeters, and a thickness of about 1 to 5 millimeters. The razor blade seat 504 and the guard 506 may be formed of any suitable material sufficiently rigid to hold its shape such as polypropylene.

In some embodiments, the razor blade seat 504 may hold five razor blades 502. The razor blades 502 may have a length of about 10 to 75 millimeters, a width of about 1 to 10 millimeters, and a thickness of about 0.05 to 1 millimeters. The razor blades 502 should be sufficiently rigid, durable, and sharp to sever a hair as in FIG. 6. The razor-blades 502 should also be formed of a non-corrosive material such as stainless-steel or high carbon steel. Further, the razor blades 502 should be at an angle and arrangement sufficient to sever a hair protruding from the skin when the razor-heads 500 are moved along the skin.

The pivotal joints 300 should be configured to allow each razor-head 500 to rotate around at least two distinct axes-of-rotation, as in FIG. 2. The radial movement of each razor-head 500 being independent of the radial movement of any other razor-head 500, as in FIG. 2. In some embodiments, as in FIG. 5, each of the razor-heads 500 rotates around a first axis-of-rotation A that extends laterally along the connected arm 400. In some embodiments, as in FIG. 5, each razor-head also rotates around a second axis-of-rotation B that is generally perpendicular to the first axis-of-rotation A.

In some embodiments, as in FIG. 2, each pivotal joint 300 may provide rotation around one axis-of-rotation. In some embodiments, as in FIG. 2, the pivotal joints 300 may be located between the distal portion of the handle 204 and the proximal portion of the arms 400. As in FIG. 2, Some embodiments may include a first plurality of pivotal joints and a second plurality of pivotal joints. In some embodiments as in FIG. 2, the first and second plurality of pivotal joints 300 may allow each razor-head 500 to rotate around two perpendicular axes-of-rotation.

In some embodiments, as in FIG. 1, each pivotal joint 300 of the first plurality of pivotal joints may have a hollow cylindrical receptacle 304. Each hollow cylindrical receptacle 304 may connect to the round shaft portion 402 of one of the arms 400. In some embodiments, such as in FIG. 1, each one of the round shaft portions 402 of an arm 400 may be disposed in one of the hollow cylindrical receptacle of the first plurality of pivotal joints. In some embodiments, as in FIG. 2, the shaft portion 402 of the arm 400 may rotate within the hollow cylindrical receptacle 304 providing rotation around the first axis-of-rotation A.

In some embodiments, as in FIG. 2, a second plurality of pivotal joints may be provided using 2-piece compression rivets 302. In some embodiments, such as in FIG. 2, the second plurality of pivotal joints may provide rotation around the second axis-of-rotation B.

In the embodiment depicted in FIG. 1, the rivets 302 may have a diameter of 0.25 to about 3 millimeters and a length of about 10 to 20 millimeters. In some embodiments, the distance between the center of each rivet 302 may be about 10 to 30 millimeters. In some embodiments, the width surrounding the rivet 302 may be about 1 to 5 millimeters. In some embodiments, the outer diameter of each hollow cylindrical receptacle 304 may be about 5 to 15 millimeters and the inner diameter of each hollow cylindrical receptacle 304 may be about 2 to 12 millimeters. In some embodiments, the length of each hollow cylindrical receptacle 304 may be about 15 to 25 millimeters.

The pivotal joints 300 may be formed from any suitable material sufficiently rigid to hold the desired shape and durable enough to prevent breaking, cracking, or unrecoverable deformation under the pressure necessary for the razor-heads 500 to operate. The pivotal joints 300 may be composed of non-corrosive material that does not deform or degrade when exposed to water such as polypropylene. Some embodiments may have stainless steel rivets 302.

Alternatively, the handle 200 may be straight, curved, or ergonomically-configured to improve grip, reduce stress, enhance comfort or, improve the ease of holding the handle 200. The handle 200 may be of any suitable shape and size known to one skilled in the art. In some embodiments the handle 200 may be textured, grooved, or contain other materials to enhance the grip, and improve comfort. Further, some embodiments, as in FIG. 3, may offer a handle 200 that rotates around a third axis-of-rotation C. In some embodiments, the handle 200 may alternatively be composed of acrylonitrile butadiene styrene, polystyrene, polyethylene, polyurethane, polycarbonate, polyester, polyethylene terephthalate, polyvinyl chloride, any vinyl material, acrylic, polyacrylate, or any other polymeric material known to one skilled in the art. Some embodiments may include thermoplastic or thermosetting polymers. Some embodiments may incorporate an elastomeric material to add flexibility to the handle 200. Alternatively, the handle 200 may also be composed of metal, wood or any other suitable material known to one skilled in the art. Some embodiments may include a handle 200 composed of multiple materials.

The arms 400 may alternatively be straight, curved, round, rectangular, polygonal or any other suitable shape known to one skilled in the art. In some embodiments, the arms 400 may also be of other suitable sizes. Some embodiments may include a permanent or temporary mechanism for connecting the arms 400 to the handle 200. If temporarily connected, the arms 400 may be released by a button, a fastening screw, a lever, a switch, a tightening screw or other suitable mechanism known to one skilled in the art. Alternatively, some embodiments may include portions of the arms 400 that are splined such as the round shaft portion 402. The arms 400 may be composed of acrylonitrile butadiene styrene, polystyrene, polyethylene, polyurethane, polycarbonate, polyester, polyethylene terephthalate, polyvinyl chloride, any vinyl material, acrylic, polyacrylate, or any other polymeric material known to one skilled in the art. Some embodiments may include thermoplastic or thermosetting polymers. Some embodiments may incorporate an elastomeric material to add flexibility. Alternatively, the arms 400 may also be composed of metal, wood, or any other suitable material known to one skilled in the art. Some embodiments may include arms 400 composed of multiple materials.

Alternatively, the razor-heads 500 may be of other suitable shapes and sizes. Some embodiments may include razor-heads 500 with fewer than five razor blades 502. In some embodiments, each razor blade seat 504 may hold three razor blades 502. In some embodiments each razor blade seat 504 may hold a single razor blade 502. Some embodiments may include razor-heads 500 with more than five razor blades 502. In some embodiments, each razor blade seat 504 may hold seven razor blades 502. In some embodiments, each razor blade seat 504 may hold twelve razor blades 504. The razor blades 502 may alternatively be composed of martensitic stainless steel, tool steel, other alloy steels, aluminum, cobalt, titanium alloys, or any other suitable metals known to one skilled in the art. In some embodiments, the razor-heads 500 may be composed of acrylonitrile butadiene styrene, polyethylene, polystyrene, polyurethane, polycarbonate, polyester, polyethylene terephthalate, polyvinyl chloride, any vinyl material, acrylic, polyacrylate, or any other polymeric material. The razor-heads 500 may be composed of thermoplastic or thermosetting polymers. The razor-heads 500 may be smooth or made of materials with lower coefficients of friction to reduce irritation to skin. Other materials for the razor-heads 500 and razor blades 502 may be suitable and known to one skilled in the art. Alternatively, some embodiments may include razor-heads 500 composed of metal, wood, or any other suitable material known to one skilled in the art. Some embodiments may include razor-heads 500 composed of multiple materials.

In some embodiments, as in FIG. 1, each razor-head 500 may be what is known to one skilled in the art as a cartridge. A cartridge comprises all the components of a razor-head 500 and is removably connected. The components comprising a cartridge are fused, cemented or otherwise attached. Cartridges are intended to be detachable to allow the user to replace used cartridges with new or alternative cartridges. In some embodiments, each cartridge may connect using one or more male protrusions with one or more female channels 508. In some embodiments, once the male protrusion is inserted into the female channel one or more leaf springs may hold it in place. In some embodiments, each cartridge may be released by pressing a button 510. When the button 510 is pressed it may push one or more leaf springs away from one or more male protrusions. Some embodiments may alternatively use hooks, rivets, tabs, live hinges, mounting flanges, screws, jaws, or a combination thereof to connect each cartridge. Some embodiments may include other connecting mechanisms known to one skilled in the art. Alternatively, in some embodiments, the razor-heads 500 may be permanently connected.

Alternatively, some embodiments of the shaver 100 may include razor-heads 500 wherein the razor-heads 500 are not removeable cartridges. Some embodiments may include razor-heads 500 wherein only the razor blades 502 are removeable. Replaceable razor blades 502 may be connected by clamps, jaws, rivets, screws, channels, hooks, levers, leaf hinges, live hinges, mounting flanges or any other mechanism known to one skilled in the art.

In some embodiments, one skilled in the art may arrange the razor blades 502 in the razor blade seat 504 to expose only one edge, forming what is known to one skilled in the art as a safety-razor. One skilled in the art may know other ways of providing minimal risk of cutting the skin and may incorporate such features of safety-razors. The razor-heads 500 may contain all the features understood by one skilled in the art for improving the safety, functionality, and comfort of the shaver 100. This includes but is not limited to shave-aiding agents such as lubricating or soothing lotions, shave-aiding components such as curved razor blades, razor blades that move slightly to provide a dynamic response feature that adjust to minor changes in the contours of the skin during use, or self-cleaning mechanisms. In some embodiments, as in FIG. 6, the razor-heads 500 may be flexible or move slightly to ensure they lay flat or in the proper orientation for the razor blades 502 to sever a hair. This movement or flexibility may be incorporated by a living hinge, leaf spring, rivet, a pivot point, a pivotal surface or any other apparatus known to one skilled in the art.

Alternatively, the pivotal joints 300 may be located at the connections between the arms 400 and the razor-heads 500. In some embodiments, the pivotal joints 300 may be within the arms 400. Some embodiments may include only a first plurality of pivotal joints 300 or a single pivotal joint 300 for each razor-head wherein each pivotal joint 300 allows each razor-head to rotate around two distinct axes-of-rotation. Some embodiments may include pivotal joints 300 that allow rotation around more than two distinct axes-of-rotation. Alternatively, some embodiments may include more than a first and second plurality of pivotal joints 300. For example, some embodiments may employ a single pivotal joint, two pivotal joints, three pivotal joints or more to allow rotations around three or more axes-of-rotation. Some embodiments may have pivotal joints 300 located in different locations for different razor-heads 500. For example, one embodiment may include three razor-heads 500, wherein the center razor-head 500 has a pivotal joint 300 located at the connection between the razor-head 500 and the arm 400 while the peripheral razor-heads 500 have pivotal joints 300 located at the connections between the arms 400 and the handle 200. Some embodiments may include multiple pivotal joints 300 located at different positions. For example, in some embodiments, a first plurality of pivotal joints 300 may be located at the connections between the arms 400 and the handle 200, and a second plurality of pivotal joints 300 may be located at the connection between the arms 400 and razor-heads 500. In some embodiments the razor-heads 500 may rotate around distinct axes-of-rotation that are not generally perpendicular. Some embodiments may limit the rotation around one or more pivotal joints 300 to less than 360 degrees.

Some embodiments may contain pivotal joints 300 of different shapes and sizes. Some embodiments may provide pivotal joints 300 using a ball-and-socket mechanism, a collar-and-disk mechanism, or any other mechanisms known to one skilled in the art. Some embodiments may create a pivotal joint using a pin or screw. Some embodiments may use a combination thereof. Alternatively, embodiments that use rivets may use any type of rivets such as semi-tubular rivets, tubular rivets, blind rivets, Oscar rivets, drive rivets, flush rivets, friction-lock rivets.

Some embodiments may include teeth at adjacent portions of a pivotal joint 300 to restrict the pivotal joint 300 from rotating and lock the position. Some embodiments may include splined portions to restrict the rotation and lock the position of any pivotal joint 300. Some embodiments may include polygon shaped portion to restrict the rotation. Some embodiments may include friction engagement to restrict the rotation and lock the position at any pivotal joint 300. Alternatively, a screw, pin, rivet, clamp, lever, latch, or a spring may be used to restrictive the rotation and lock the position of a pivotal joint 300. Some embodiments may require detaching parts and reattaching parts in new positions around an axis-of-rotation to lock the position. Alternatively, displacement may be used to disengage and engage restrictive elements. For example, in FIG. 1, the interior of the proximal portion of each hollow cylindrical receptacle 304 could be splined and the round shaft portion 402 of each arm 400 could be splined. In embodiments with splined portions, rotation of the arms 400 would be restricted when fully disposed in the hollow cylindrical receptacle 304 but allow the user to rotate the arms 400 when displaced in the distal direction. Alternatively, teeth located at the connection between the round shaft portion 402 of each arm 400 and the downward sloping portion 404 of each arm 400 could be engaged and disengaged with teeth located at the most distal portion of the hollow cylindrical receptacle 304. In embodiment with teeth at strategic locations the restrictive element could be disengaged by moving the arm in the distal direction and engaged by moving the arm in the proximal direction. In some embodiments the displacement could be manual. Alternatively, the displacement could be assisted by an elastomer, in what is known to one skilled in the art as elastomeric displacement. In elastomeric displacement an elastomeric material is attached to a portion of each adjacent part. The elastomeric material when at rest engages the restrictive element locking the position of the pivotal joint, however when stressed, either by pushing or pulling the adjacent parts, the elastomeric material is stretched so the restrictive element can be disengaged and the adjacent parts can be rotated. After releasing the adjacent parts, the elastomeric material returns to its rest position engaging the restrictive elements and locking the position. Some embodiments may include a combination thereof.

If an elastomeric material is included it may be composed of polyisoprene, polybutadiene, ethylene propylene diene, nitrile butadiene, urethanes, rubbers or any other suitable material known to one skilled in the art. In some embodiments, the pivotal joints 300 may alternatively be composed of acrylonitrile butadiene styrene, polystyrene, polyethylene, polyurethane, polycarbonate, polyester, polyethylene terephthalate, polyvinyl chloride, any vinyl material, acrylic, polyacrylate, or any other polymeric material. Some embodiments may include thermoplastic or thermosetting polymers. The pivotal joint 300 may also be composed of metal, wood or any other suitable material known to one skilled in the art. Some embodiments may include pivotal joint 300 composed of multiple materials. For example, the rivets 302 may be composed of stainless steel or plastic-coated aluminum and the remaining portion of the pivotal joints may be composed of polypropylene.

Some embodiments may further contain a light for illuminating the skin. An example of a shaver containing a light is disclosed in U.S. Pat. No. 4,094,062 and incorporated by reference in its entirety. The light may include an incandescent or luminescent lamp such as a light emitting diode (LED) bulb. In some embodiments, the light will be located at the distal portion of the shaver 100. Embodiments with a light should have a power source such a battery or multiple batteries. In some embodiments, the power source may use one or more rechargeable batteries. In some embodiments, the power source may use one or more disposable batteries. In some embodiments, the power source may be located within the handle 200. The power source and connecting wires may be covered and sealed to prevent water damage. Examples of a power source located in the handle are disclosed in U.S. Pat. Nos. 5,007,169, 8,683,701, U.S. Patent Publication No. 2010/0313425 and incorporated by reference in their entirety.

The plastic and elastomeric portions of the shaver 100 may be created by extrusion molding, injection molding, 3D printing or a combination thereof. The razor blades 502 may be annealed, temperature treated, and stamped out. Alternatively, the shaver 100 and its components may be produce by any other method known to one skilled in the art.

The above disclosure discusses several embodiments however it is not limited to the discussed embodiments. It is to be understood that the disclosure of the invention in this specification includes all possible combinations of the disclosed features. Those skilled in the art will envision other embodiments and adaptations within the scope and spirit of the invention.

The invention claimed is:

1. A shaver comprising:

a handle with a proximal portion and a distal portion;

a plurality of arms each with a proximal portion and a distal portion, the proximal portion of each said arm connected to the distal portion of the handle;

a plurality of razor-heads, each said razor-head connected to the distal portion of a respective one of the plurality of arms, wherein each of the plurality of razor-heads connections includes a dynamic response feature, the dynamic response feature being a living hinge, a leaf spring, a rivet, a pivot point, or a pivotal surface such that each razor-head moves; and a plurality of pivotal joints;

wherein, each razor-head rotates around at least two distinct axes-of-rotation independent of the rotation of any of the other razor-heads via a respective one of the pivotal joints.

2. The shaver of claim 1, wherein each pivotal joint is respectively located at a connection between a respective one of the arms and the handle.

3. The shaver of claim 1, wherein each pivotal joint is respectively located at a connection between a respective one of the razor-heads and the handle.

4. The shaver of claim 1, wherein the pivotal joints are located within the plurality of arms.

5. The shaver of claim 1, wherein the pivotal joints include a first plurality of pivotal joints and a second plurality of pivotal joints wherein at least two pivotal joints including a pivotal joint from each of the first and second plurality of pivotal joints are connected to the respective one of the plurality of razor-heads.

6. The shaver of claim 5, wherein each razor-head rotates around three or more axes-of-rotation independent of the rotation of any other razor-head.

7. The shaver of claim 5, wherein each arm is rotatably connected to the distal portion of the handle forming the first plurality of pivotal joints.

8. The shaver of claim 5, wherein the first plurality of pivotal joints allows each razor-head to rotate around a first axis-of-rotation of the at least two distinct axes-of-rotation that is generally parallel to a respective one of the plurality of the arms, and the second plurality of pivotal joints that allow each razor-head to rotate around a second axis-of-rotation of the at least two distinct axes-of-rotation that is generally perpendicular to the first axis-of-rotation.

9. The shaver of claim 1, wherein the razor-heads are removeable cartridges.

10. The shaver of claim 1, wherein the handle rotates around an axis-of-rotation.

11. The shaver of claim 1, further comprising bi-directional razor blades.

12. The shaver of claim 1, further comprising at least one razor-head with a fixed orientation.

13. The shaver of claim 1, further comprising at least one locking mechanism for restricting the rotation of a razor-head from the plurality of razor-heads around an axis-of-rotation from the at least two distinct axes-of-rotation.

14. The shaver of claim 1, further comprising a light source, and a power source located within the handle and configured to power the light source.

15. The shaver of claim 1, wherein each living hinge, leaf spring, rivet, pivot point, or pivotal surface is configured so the respective razor-head lays flat or in a proper orientation.

16. A shaver comprising:

a handle with a proximal portion and a distal portion;

a plurality of arms each with a proximal portion and a distal portion, the proximal portion of each said arm connected to the distal portion of the handle forming a plurality of first connections;

a plurality of razor-heads, each said razor-head connected to the distal portion of a respective one of the plurality of arms forming a plurality of second connections; and pivotal means for rotating the plurality of razor-heads and being located at the plurality of first connections;

wherein, each razor-head rotates around at least two distinct axes-of-rotation independent of the rotation of any other razor-head.

17. The shaver of claim 16, wherein the pivotal means includes a first pivotal means and a second pivotal means, the first and second pivotal means cooperating to allow each razor-head to rotate around a first axis-of-rotation and a second axis-of-rotation of the at least two distinct axes-of-rotation.

18. The shaver of claim 16, wherein the pivotal means includes a first plurality of pivotal means and a second plurality of pivotal means wherein at least two pivotal means including one pivotal means from the first plurality of pivotal means and another pivotal means from the second plurality of pivotal means are connected to each said razor-head of the plurality of razor-heads.

19. A shaver comprising:

a handle;

a plurality of joints pivotal connected to the handle;

a plurality of arms, each of the arms connected to a respective one of the pivotal joints;

a plurality of razor-heads having a face of blades, each of the razor-heads being connected to a respective one of the plurality of arms each of the razor-heads including a dynamic response feature, wherein each dynamic response feature enables a respective one of the razor-heads to move about a dynamic axis parallel to the face of the blades; and wherein the pivotal joints enable each razor-head to independently rotate around at least two distinct razor-head axes-of-rotation.

20. The shaver of claim 18, wherein the dynamic response features are spaced from the pivotal joints such that the razor-head axes-of-rotation are spaced from the dynamic axis.

* * * * *